US006642189B2

(12) United States Patent
Kurihara et al.

(10) Patent No.: US 6,642,189 B2
(45) Date of Patent: Nov. 4, 2003

(54) ENGINE OIL COMPOSITIONS

(75) Inventors: Isao Kurihara, Yokohama (JP); Jinichi Igarashi, Yokohama (JP); Kiyoshi Inoue, Yokohama (JP)

(73) Assignee: Nippon Mitsubishi Oil Corporation, Tokyo (JP)

( * ) Notice: Subject to any disclaimer, the term of this patent is extended or adjusted under 35 U.S.C. 154(b) by 0 days.

(21) Appl. No.: 10/317,639

(22) Filed: Dec. 12, 2002

(65) Prior Publication Data

US 2003/0162673 A1 Aug. 28, 2003

Related U.S. Application Data

(63) Continuation-in-part of application No. 09/739,433, filed on Dec. 18, 2000.

(30) Foreign Application Priority Data

Dec. 22, 1999 (JP) ..... 11-365445

(51) Int. Cl.[7] ..... C10M 145/14; C10M 171/02
(52) U.S. Cl. ..... 508/364; 508/469; 508/470
(58) Field of Search ..... 508/364, 469, 508/470

(56) References Cited

U.S. PATENT DOCUMENTS

| | | | |
|---|---|---|---|
| 4,844,829 | A | 7/1989 | Wilburn et al. |
| 5,188,770 | A | 2/1993 | Pennewiss |
| 5,281,347 | A | 1/1994 | Igarashi et al. |
| 5,322,632 | A | 6/1994 | Gambini et al. |
| 5,520,832 | A | 5/1996 | Alexander |
| 5,641,732 | A | 6/1997 | Bloch et al. |
| 5,646,099 | A | 7/1997 | Watts et al. |
| 5,688,748 | A | 11/1997 | Tomizawa |
| 5,726,136 | A | 3/1998 | Koch |
| 5,744,430 | A | 4/1998 | Inoue et al. |
| 5,756,433 | A | 5/1998 | Auschra et al. |
| 5,916,851 | A | 6/1999 | Hosonuma et al. |
| 6,034,040 | A | 3/2000 | Ozbalik et al. |
| 6,124,249 | A | 9/2000 | Seebauer et al. |

FOREIGN PATENT DOCUMENTS

| | | | |
|---|---|---|---|
| EP | 0 757 093 | A1 | 7/1996 |
| EP | 0 931 827 | A1 | 1/1998 |
| EP | 1 013 749 | A2 | 12/1999 |
| JP | 08-302378 | A | 11/1996 |

OTHER PUBLICATIONS

Bagnall, R.A., et al., "Significant Considerations in Selecting Base Stocks for Automatic Transmission Fluids", Gulf Canada Limited, SAE Paper No. 821242:107–128 (1982).

*Primary Examiner*—Ellen M. McAvoy
(74) *Attorney, Agent, or Firm*—Akin, Gump, Strauss, Hauer & Feld, L.L.P.

(57) ABSTRACT

Engine oil compositions are provided containing (A) a lubricating base oil having a kinematic viscosity at 100° C. of 3 to 6 $mm^2/S$, a viscosity index of 120 or more, and a total aromatic content of 5 percent by mass or less and (B) a polymethacrylate-based viscosity index improver, preferably having a weight average molecular weight of 180,000 or more, (A) and (B) being blended in such an amount that the composition has a kinematic viscosity at 100° C. of 4.0 to 9.3 $mm^2/s$. The engine oil compositions may also contain a molybdenumdithiocarbamate, as well as one or more other engine oil additives. The engine oil compositions preferably have a high-temperature, high shear viscosity at 150° C. of 2.4 to 2.7 mPa·s, a NOACK evaporation loss of 16 percent by mass or less, and a CCS viscosity at −25° C. of 3500 mPa·s or less.

18 Claims, No Drawings

ENGINE OIL COMPOSITIONS

CROSS-REFERENCE TO RELATED APPLICATIONS

This application is a continuation-in-part of U.S. patent application Ser. No. 09/739,433, filed Dec. 18, 2000, the contents of which are incorporated herein by reference.

BACKGROUND OF THE INVENTION

This invention relates to engine oil compositions, and more particularly to engine oil compositions which provide excellent fuel efficiency and viscosity at low temperatures and are lower in evaporation loss.

The fuel consumption reduction of automobile engines implemented since the oil crisis is still one of the important issues from the view point of resource- and environment-protection. The fuel consumption reduction of automobiles has been put into practice by reducing the body weight of an automobile, improving combustion efficiency, and reducing the occurrence of friction in an engine. The reduction of friction in engines has been implemented by improving the movable valve structures, reducing the number of piston rings, smoothing the abrasive surfaces of sliding parts, and using fuel efficient engine oils.

Among these measures for reducing fuel consumption, the use of such fuel efficient engine oils has become general in the market because of their excellent balance of cost and performance. The engine oils are blended with effective additives such as friction modifiers. However, in order to make friction modifiers exhibit their performance sufficiently, it is important to carefully select a base oil and formulate the other engine oil additives.

Japanese Laid-Open Patent Publication No. 8-302378 discloses an engine oil composition which comprises a specific base oil, an alkaline earth metal salicylate-based detergent, zinc dialkyldithiophosphate, a polybutenylsuccinimide-based ashless dispersant, a phenol-based ashless oxidation inhibitor, a molybdenumdithiocarbamate-based friction modifier, a viscosity index improver, in specific amounts, respectively.

Reducing the viscosity of an engine oil is considered to be one of the measures to provide an engine oil with good fuel efficiency. However, insufficient investigation or research has been done on a base oil or additives for a low viscosity engine oil.

BRIEF SUMMARY OF THE INVENTION

An object of the present invention is to blend suitable additives to provide an engine oil composition which is reduced in viscosity compared to conventional fuel efficient engine oils and provides excellent fuel efficiency and viscosity characteristics at low temperatures with less evaporation loss.

As a result of extensive research and development, it was found that an engine oil composition which is reduced in viscosity compared to conventional fuel efficient engine oils, provides excellent fuel efficiency and viscosity characteristics at low temperatures, and is lower in evaporation loss can be obtained by blending a specific base oil with a specific amount of a polymethacrylate-based viscosity index improver.

According to one embodiment of the present invention there is provided an engine oil composition consisting essentially of (A) lubricating base oil having a kinematic viscosity at 100° C. of 3 to 6 $mm^2/s$, a viscosity index of 120 or more, and a total aromatic content of 5 percent by mass or less and (B) a polymethacrylate-based viscosity index improver having a weight-average molecular weight of 180,000 or more, blended in such an amount that the composition has a kinematic viscosity at 100° C. of 4.0 to 9.3 $mm^2/s$ and a high temperature high shear viscosity at 150° C. of 2.4 to 2.7 mPa·s.

According to another embodiment of the present invention there is provided an engine oil composition consisting essentially of (A) a lubricating base oil having a kinematic viscosity at 100° C. of 3 to 6 $mm^2/s$, a viscosity index of 120 or more, and a total aromatic content of 5 percent by mass or less and (B) a polymethacrylate-based viscosity index improver having a weight-average molecular weight of 180,000 or more, blended in such an amount that the composition has a kinematic viscosity at 100° C. of 4.0 to 9.3 $mm^2/s$ and a high temperature high shear viscosity at 150° C. of 2.4 to 2.7 mPa·s, and (C) a molybdenumdithiocarbamate.

DETAILED DESCRIPTION OF THE INVENTION

A lubricating base oil referred to as Component (A) in an engine oil composition according to the present invention has a kinematic viscosity at 100° C. of which the upper limit is 6 $mm^2/s$, preferably 5 $mm^2/s$ and the lower limit is 2 $mm^2/s$, preferably 3 $mm^2/s$. Lubricant base oils having kinematic viscosities, in excess of the upper limit would lead to increased fluid resistance resulting in increased loss caused by wear occurring at engine parts to be lubricated, while those of less than the lower limit would lead to insufficient oil-film formation, resulting in less lubricity and increased evaporation loss.

Component (A) has necessarily a viscosity index of 120 or more. Such a viscosity index value contributes to the production of an engine oil composition having excellent low-temperature viscosity characteristics. Base oils having a viscosity index of less than 120 would lead to a necessity to bring it down to a lower viscosity, resulting in an increased evaporation loss and viscosity of the resulting engine oil.

The upper limit of aromatic content of Component (A) is 15 percent by mass, preferably 10 percent by mass, and most preferably 5 percent by mass. Base oils having an aromatic content in excess of the upper limit would fail to achieve synergistic effects with each additive to be used in the present invention. No particular limitation is imposed on the lower limit of aromatic content. However, Component (A) preferably has a total aromatic content of 2 percent by mass or more, because a Component (A) having a total aromatic content of less than 2 percent by mass would possibly not exhibit solubility to various additives.

The term "total aromatic content" used herein denotes an aromatic fraction content measured in accordance with ASTM D2549. Included in the aromatic fraction are generally alkylbenzenes, alkylnaphthalenes, anthracene, phenanthrene, alkylated products thereof, compounds in which 4 or more benzene rings are condensed, and compounds having hetero-aromatics, such as pyridines, quinolines, phenols, and naphthols.

Eligible base oils for the present invention are mineral lubricating oils, synthetic, lubricating oils, and mixtures of two or more of these oils mixed in a suitable ratio.

For instance, the base oils are exemplified by mineral lubricating oils, mixtures of mineral lubricating oils and non-aromatic-containing synthetic lubricating oils, and mixtures of aromatic-containing synthetic lubricating oils and non-aromatic-containing synthetic lubricating oils.

The term "mineral lubricating oil" used herein denotes not only a single mineral lubricating oil but also a mixture of two or more mineral lubricating oils. Therefore, when using two more mineral lubricating oils as the base oil, there may be used not only a mixture of mineral lubricating oils each having a total aromatic content of 15 percent by mass or less but also a mixture of a mineral lubricating oil having a total aromatic content of less than 15 percent by mass and a mineral lubricating oil having a total aromatic content exceeding 15 percent by mass, as long as the resulting base oil has a total aromatic content of 15 percent by mass or less.

Furthermore, when using a mixture of a mineral lubricating oil and a non-aromatic-containing synthetic lubricating oil, there may be used a mineral lubricating oil having a total aromatic content exceeding 15 percent by mass as long as the resulting base oil has a total aromatic content of 15 percent by mass or less.

Specific examples of the mineral lubricating oil are those obtained by subjecting a lubricant fraction obtained by vacuum-distilling an atmospheric residue derived from the atmospheric distillation of crude oil to one or more refining processes such as solvent deasphalting, solvent extraction, hydrocracking, solvent dewaxing, and hydrorefining.

Specific examples of the aromatic-containing synthetic lubricating oil are alkylnaphthalenes and alkylbenzenes.

Specific examples of the non-aromatic-containing synthetic lubricating oil are polybutens and hydrides thereof; poly-α-olefins such as 1-octene oligomer and 1-decene oligomer, and hydrides thereof; diesters such as ditridecylglutarate, di-2-ethylhexyladipate, diisodecyladipate, and di-2-ethylhexylcebacate; polyolesters such as trimethylolpropanecaprylate, trimethylolpropanepelargonate, pentaerythritol-2-ethylhexanoate, and pentaerythritolpelargonate; and mixtures thereof.

Each of these lubricating oils exhibits its peculiar viscosity-temperature characteristics, i.e., viscosity index. As long as a lubricating oil used as a base oil of the present invention has a viscosity index of 120 or more, even though a lubricating base selected from the above has a viscosity index of less than 120, it may be used in combination with those having a viscosity index of 120 or more.

Component (B) of an engine oil composition according to the present invention is a polymethacrylate-based viscosity index improver blended in such an amount that the resulting composition has a kinematic viscosity at 100° C. of 4.0 to 9.3 $mm^2/s$. A kinematic viscosity of the resulting composition at 100° C. in excess of 9.3 $mm^2/S$ would not provide sufficient fuel efficiency, while a kinematic viscosity of less than 4.0 $mm^2/s$ would improve fuel efficiency caused by the reduced viscosity of the composition and viscosity at low temperatures, but would fail to have sufficient lubricity as an engine oil.

The high temperature high shear viscosity (1HTHS viscosity) of the composition of the present invention at 150° C. should be 2.4 to 2.7 mPa·s. The HTHS viscosity is preferably within the range of 2.4 to 2.65 mPa·s and more preferably 2.55 to 2.65 mPa·s. An HTHS viscosity of the composition in excess of 2.7 mPa·s would result in poor fuel efficiency, while an HTHS viscosity of less than 2.4 mPa·s would result in poor anti-abrasion properties.

The NOACK evaporation loss (ASTM D 5800) of the composition of the present invention is preferably 16 percent by mass or less and particularly preferably 15 percent by mass or less. A composition having a NOACK evaporation in excess of 16 percent by mass would increase the engine oil consumption and also result in a deterioration of fuel efficiency and concentration of additives, leading to the necessity to replenish or exchange the engine oil more often, which is not economical.

The CCS viscosity (ASTM 5293) of the inventive composition at −25° C. is preferably 3500 mPa·s or less and more preferably 3300 mPa·s or less. A composition having a CCS viscosity in excess of 3500 mPa·s would be deteriorated in low temperature engine startability.

The combination of a base oil with such a polymethacrylate-based viscosity index improver in an engine oil composition according to the present invention results in enhanced viscosity index improving effects, less thickening effects, and excellent pour point reduction effects. The polymethacrylate-based viscosity index improver is indispensable in an engine oil composition according to the present invention in order to provide it with excellent low temperature characteristics.

When using known polyolefin copolymer-based viscosity index improvers, the same effects as the present invention cannot be achieved.

The polymethacrylate-based viscosity index improvers which may be used in the present invention are any type of non-dispersion type or dispersion type polymethacrylate compounds which are used as viscosity index improvers for a lubricating oil.

The non-dispersion type polymethacrylate-based viscosity index improver may be a polymer of a compound represented by the formula

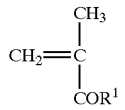

(1)

In formula (1) $R^1$ is a straight chain or branched alkyl group such as methyl, ethyl, propyl, butyl, hexyl, heptyl, octyl, nonyl, decyl, undecyl, dodecyl, tridecyl, tetradecyl, pentadecyl, hexadecyl, heptadecyl, and octadecyl groups.

Specific examples of the dispersion type polymethacrylate-based viscosity index improver are copolymers obtained by copolymerizing one or more monomers selected from compounds represented by formula (1) with one or more nitrogen-containing monomers selected from compounds represented by formulae (2) and (3)

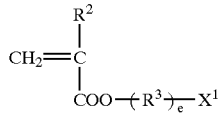

(2)

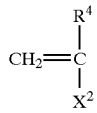

(3)

In formulae (2) and (3) $R^2$ and $R^4$ are each independently hydrogen or methyl. $R^3$ is a straight chain or branched alkylene group having 1 to 18 carbon atoms, such as ethylene, propylene, butylene, pentylene, hexylene, heptylene, octylene, nonylene, decylene, undecylene, dodecylene, tridecylene, tetradecylene, pentadecylene, hexadecylene, heptadecylene, and octadecylene groups. e is an integer of 0 or 1. $X^1$ and $X^2$ are each independently an amino- or heterocyclic- residue having 1 or 2 nitrogen atoms and 0 to 2 oxygen atoms. Specific examples of $X^1$ and $X^2$ are dimethylamino, diethylamino, dipropylamino, dibutylamino, anilino, toluidino, xylidino, acetylamino, benzoilamino, morpholino, pyrolyl, pyridyl, methylpyridyl, pyrolidinyl, piperidinyl, quinonyl, pyrrolidonyl, pyrrolidono, imidazolino, and pyrazino groups.

Specific examples of the nitrogen-containing monomers represented by formula (2) or (3) are dimethylarninomethylmethacrylate, diethylaminomethylmethacrylate, dimethylaaminoethylmethacrylate, diethylaminoethylmethacrylate, 2-methyl-5-vinylpyridine, morpholinomethylmethacrylate, morpholinoethylmethacrylate, N-vinylpyrrolidone, and mixtures thereof.

Regardless of the weight-average molecular weight of the polymethacrylate-based viscosity index improver, it can improve the low temperature viscosity characteristics. However, the lower limit of the weight-average molecular weight of the polymethacrylate-based viscosity index improver, which is effective in improving the performance of an engine oil, is preferably 180,000, more preferably 190,000. Polymethacrylate-based viscosity index improvers having a weight-average molecular weight of 180,000 or more can decrease the amount of other viscosity index improvers to be added so as to further improve low temperature viscosity, not only leading to an advantage in terms of cost but also an improvement in shear stability, such that the initial performance of the resulting engine oil can be maintained. No particular limitation is imposed on the upper limit. When consideration is given to an easy treatment of the composition, it is preferably 500,000 or less and more preferably 400,000 or less.

As described above, an engine oil composition according to the present invention contains the polymethacrylate-based viscosity index improver in such an amount that the composition has a kinematic viscosity at 100° C. of 4.0 to 9.3 $mm^2/s$. As long as the kinematic viscosity at 100° C. of an engine oil composition is within this range, the content of a polymethacrylate-based viscosity index improver may be arbitrarily selected. However, the content is preferably from 0.5 to 10 percent by mass based on the total weight of the composition.

In order to further enhance fuel efficiency, an engine oil composition according to the present invention may be blended with a molybdenumdithiocarbamate represented by formula (4) or mixtures thereof (4)

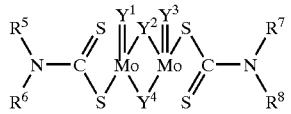

In formula (4) $R^5$, $R^6$, $R^7$, and $R^8$ may be the same or different, and each is independently an alkyl or alkylaryl group having 2 to 18 carbon atoms. $Y^1$, $Y^2$, $Y^3$, and $Y^4$ are each independently sulfur or oxygen. The alkyl group includes primary, secondary, and tertiary alkyl groups which may be straight chain or branched. Specific examples of the alkyl group are ethyl, propyl, butyl, pentyl, hexyl, octyl, decyl, dodecyl, and tridecyl groups. Specific examples of the molybdenumdithiocarbamate are molybdenumdiethyldithiocarbamate sulfide, molybudenumdipropyldithiocarbamate sulfide, molybdenumdibutyldithiocarbamate sulfide, molybdenumdipentyldithiocarbamate sulfide, molybdenumdihexyldithiocarbamate sulfide, molybdenumdioctyldithiocarbamate sulfide, molybdenumdidecyldithiocarbamate sulfide, molybdenumdidecyldithiocarbamate sulfide, molybdenumditridecyldithiocarbamate sulfide, molybdenumdioutylphenyl)dithiocarbamate sulfide, molybdenumdi(nonylphenyl)dithiocarbamate sulfide, oxymolybdenumdiethdyldithiocarbamate sulfide, oxymolybdenumdipropyldithiocarbamate sulfide, oxymolybdenumdibutyldithiocarbamate sulfide, oxymolybdenumdipentyldithiocarbamate sulfide, oxymolybdenumdihexyldithiocarbamate sulfide, oxymolybdenumdioctyldithiocarbamate sulfide, oxymolybdenumdidecyldithiocarbamate sulfide, oxymolybdenumdidodecyldithiocarbamate sulfide, oxymolybdenumditridecyldithiocarbamate sulfide, oxymolybdenumdi(butylphenyl)dithiocarbamate sulfide, and oxymolybdenumdi(nonylphenyl)dithiocarbamate sulfide. Mixtures of these compounds may also be used.

The upper limit of molybdenum content is 0.15 percent by mass, preferably 0.10 percent by mass, in terms of molybdenum concentration, based on the total mass of the composition. A content in excess of the upper limit would cause the formation of sludge when the engine oil is deteriorated. No particular limitation is imposed on the lower limit of molybdenum content. However, the lower limit is preferably 0.02 percent by mass, more preferably 0.04 percent by mass in terms of molybdenum concentration, based on the total mass of the composition in order to obtain a sufficient friction reduction effect.

As described above, an engine oil composition according to the present invention excels in fuel efficiency and low temperature viscosity and is lower in evaporation loss by blending a specific base oil with a polymethacrylate-based viscosity index improver so as to obtain a specific viscosity. Furthermore, the use of a polymethacrylate-based viscosity index improver having a weight average molecular weight of 180,000 or more can further improve fuel efficiency and low temperature viscosity. Higher levels of fuel efficiency can be provided in an engine oil by adding thereto molybdenumdithiocarbamate.

For the purpose of enhancing these various performances and various other performances required for an engine oil composition, known engine oil additives may be used singlely or in combination.

Examples of such known additives which may be used in the present invention are alkaline earth metal-based detergents, ashless dispersants, corrosion inhibitors, ashless oxidation inhibitors, friction modifiers other than molybdenumdithiocarbamates, corrosion inhibitors, demulsifying agents, metal deactivators, and antifoamers.

Eligible alkaline earth metal-based detergents are alkaline earth metal compounds which are added in a lubricating oil. Specific examples of such a detergent are one or more metallic detergents selected from alkaline earth metal sulfonates, alkaline earth metal phenates, and alkaline earth metal salicylates.

Preferred alkaline earth metal sulfonates are alkaline earth metal salts, preferably a magnesium salt and/or calcium salt of an alkyl aromatic sulfonic acid obtained by sulfonating an alkyl aromatic compound having a molecular weight of 300 to 1,500, preferably 400 to 700. The latter is more preferred.

The above-mentioned alkyl aromatic sulfonic acid may be a petroleum sulfonic acid or a synthetic sulfonic acid.

The petroleum sulfonic acid may be mahogany acid obtained by sulfonating the alkyl aromatic compound contained in the lubricant fraction of mineral oil or by-produced upon the production of white oil. The synthetic sulfonic acid may be any of those obtained by sulfonating alkyl benzene having a straight chain or branched alkyl group, which may be by-produced from a plant for producing alkyl benzene used as material of detergents, or sulfonating dinonylnaphthalene. Although not restricted, there may be used fuming sulfuric acid or sulfuric acid as a sulfonating agent.

The alkaline earth metal phenate may be an alkaline earth metal salt, preferably a magnesium salt and/or calcium salt of alkylphenol, alkylphenolsulfide, or a product resulting from Mannich reaction of the alkylphenol. Specific examples are those represented by the formulae (5)

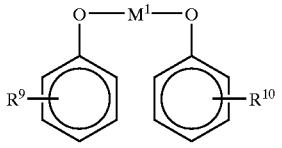

(6)

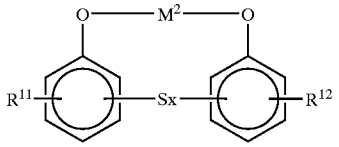

(7)

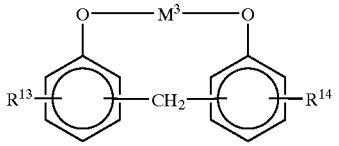

wherein $R^9$, $R^{10}$, $R^{11}$, $R^{12}$, $R^{13}$, and $R^{14}$ may be the same or different and are each independently a straight chain or branched alkyl group having 4 to 30, preferably 6 to 18 carbon atoms, $M^1$, $M^2$, and $M^3$ are each independently an alkaline earth metal, preferably calcium and/or magnesium, and x is an integer of 1 or 2.

Specific examples of $R^9$, $R^{10}$, $R^{11}$, $R^{12}$, $R^{13}$, and $R^{14}$ are butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, icosyl, heneicosyl, docosyl, tricosyl, tetracosyl, pentacosyl, hexacosyl, heptacosyl, octacosyl, nonacosyl, and triacontyl groups, all of which may be straight chain or branched and primary, secondary or tertiary alkyl groups.

The alkaline earth metal salicylate may be an alkaline earth metal salt, preferably a magnesium salt and/or calcium salt of an alkyl salicylate. Specific examples are those represented by the formula (8)

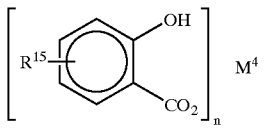

wherein $R^{15}$ is a straight chain or branched alkyl group having 4 to 30, preferably 6 to 18 carbon atoms, and $M^4$ is an alkaline earth metal, preferably calcium and/or magnesium.

Specific examples of $R^{15}$ are butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, icosyl, heneicosyl, docosyl, tricosyl, tetracosyl, pentacosyl, hexacosyl, heptacosyl, octacosyl, nonacosyl, and triacontyl groups, all of which may be straight chain or branched and primary, secondary or tertiary alkyl groups.

Moreover, the alkaline earth metal sulfonate, alkaline earth metal phenate and alkaline earth metal salicylate may be a neutral alkaline earth metal sulfonate, alkaline earth metal phenate or alkaline earth metal salicylate obtained by directly reacting a compound, such as the above-mentioned alkyl aromatic sulfonic acid, alkylphenol, alkylphenol sulfide, or the Mannich reaction product thereof, or alkyl salicylic acid with an alkaline earth metal oxide or hydroxide of magnesium and/or calcium, or obtained by converting the compound into an alkali metal salt, such as sodium salt or potassium salt, and then substituting the alkali metal salt with an alkaline earth metal salt. The alkaline earth metal sulfonate, alkaline earth metal phenate or alkaline earth metal salicylate may also be a basic alkaline earth metal sulfonate, alkaline earth metal phenate or alkaline earth metal salicylate obtained by heating a neutral alkaline earth metal sulfonate, alkaline earth metal phenate or alkaline earth metal salicylate in water containing an excess amount of an alkaline earth metal salt or an alkaline earth metal base; or an overbased alkaline earth metal sulfonate, alkaline earth metal phenate or alkaline earth metal salicylate obtained by reacting a neutral alkaline earth metal sulfonate, alkaline earth metal phenate or alkaline earth metal salicylate with the carbonic acid salt or boric acid salt of an alkaline earth metal in the presence of carbon dioxide.

In the present invention there may be used the above-described neutral alkaline earth metal salt, basic alkaline earth metal salt, overbased alkaline earth metal salt, or mixtures thereof.

Commercially available metallic detergents are usually diluted with a light lubricating base oil. It is preferred to use metallic detergents containing metal in an amount of 1.0 to 20 percent by mass, preferably 2.0 to 16 percent by mass.

No particular limitation is imposed on the total base number of the alkaline earth metal detergent used in the present invention. However, preferred metallic detergents are those having a total base number of 30 to 400 mgKOH/g, preferably 150 to 300 mgKOH/g. The term "total base number" used herein denotes a total base number measured by the perchloric acid potentiometric titration method in accordance with section 7 of JIS K2501 "Petroleum products and lubricants-Determination of neutralization number."

Although not restricted, the content of the alkaline earth metal detergent is within the range of 1.0 to 10.0 percent by mass, preferably 1.0 to 8.0 percent by mass, more preferably 1.5 to 5.0 percent by mass, based on the total mass of the composition.

Preferred ashless dispersants are any type of polybutenylsuccinimides used in a lubricating oil. Specific examples of such dispersants are mono-type imides represented by formula (9), bis-type imides represented by formula (10), and those modified with organic acid or boric acid (9)

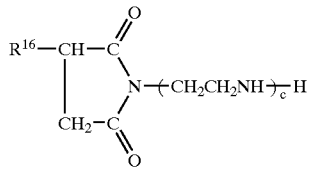

-continued (10)

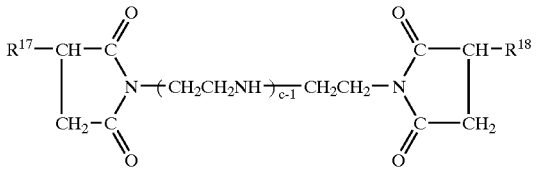

In formulae (9) and (10) $R^{16}$, $R^{17}$, and $R^{18}$ are each independently a polybutenyl group having a number-average molecular weight of 900 to 3,500, preferably 1,000 to 3,000, and c is an integer of 2 to 5.

No particular limitation is imposed on a method for producing the polybutenylsuccinimides. For instance, the polybutenylsuccinimides may be obtained by reacting polybutenylsuccinate resulting from the reaction of a polybutene or chlorinated polybutene having a number-average molecular weight of 900 to 3,500 with maleic anhydride. Specific examples of the polyamine are diethyltrinamine, triethylenetetraanine, tetraethylenepentamine, and pentaethylenehexamine.

The upper limit content of the polybutenylsuccinimide is 0.20 percent by mass, preferably 0.10 percent by mass, in terms of nitrogen concentration, based on the total mass of the composition. Contents in excess of the upper limit would adversely affect rubber-made sealing materials of an engine. No particular limitation is imposed on the lower limit content of the polybutenylsuccinimide. However, the lower limit is preferably 0.05 percent by mass, more preferably 0.06 percent by mass, in terms of nitrogen concentration, based on the total mass of the composition such that a more sufficient fuel efficiency can be achieved.

Alternatively, an engine oil composition may be blended with one or more other ashless dispersants, such as a long chain polyalkylamine, and an amide of a long chain fatty acid and a polyamine or with those in combination with the above-described polybutenylsuccinimide ashless dispersant.

Wear inhibitors used in the present invention may be one or more dialkyldithio zinc phosphates selected from compounds represented by formula (11)

(11)

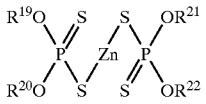

In formula (11) $R^{19}$, $R^{20}$, $R^{21}$, and $R^{22}$ are each independently a primary alkyl group having 2 to 18, preferably 4 to 12 carbon atoms or a secondary alkyl group having 3 to 18, preferably 3 to 10 carbon atoms.

The primary alkyl groups having 2 to 18 carbon atoms are those represented by the formula $$R^{23}—CH_2— \quad (12)$$

In formula (12) $R^{23}$ is a straight chain or branched alkyl group having 1 to 17, preferably 3 to 11 carbon atoms. Specific examples of $R^{23}$ are straight chain or branched alkyl groups such as methyl, ethyl, propyl, butyl, pentyl, hexyl, heptyl, octyl, nonyl, decyl, undecyl, dodecyl, tridecyl, tetradecyl, pentadecyl, hexadecyl, and heptadecyl groups.

The secondary alkyl groups having 3 to 18 carbon atoms are those represented by the formula (13)

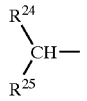

In formula (13) $R^{24}$ and $R^{25}$ are each independently a straight chain or branched alkyl group having 1 to 16, preferably 1 to 8 carbon atoms to be selected such that the total carbon number of $R^{24}$ and $R^{25}$ is 2 to 17, preferably 2 to 9 carbon atoms. Specific examples of $R^{24}$ and $R^{25}$ are straight chain or branched alkyl groups such as methyl, ethyl, propyl, butyl, pentyl, hexyl, heptyl, octyl, nonyl, decyl, undecyl, dodecyl, tridecyl, tetradecyl, pentadecyl, and hexadecyl groups.

The upper limit content of the dialkyldithio zinc phosphate is 0.10 percent by mass, preferably 0.09 percent by mass, on an elemental basis, based on the total mass of the composition. A content in excess of the upper limit would accelerate the poisoning of a ternary catalyst adversely affecting exhaust gas. No particular limitation is imposed on the lower limit content of the dialkyldithio zinc phosphate. In order to maintain the friction coefficient at a lower level after the deterioration of an engine oil, i.e., to maintain fuel efficiency longer, the lower limit is preferably 0.04 percent by mass, more preferably 0.06 percent by mass, on an elemental basis, based on the total mass of the composition.

An engine oil composition may be blended with one or more other friction modifiers, such as organic phosphates, fatty acids, fatty acid esters, aliphatic alcohols, or with those in combination with the above-described dialkyldithio zinc phosphates.

Preferred ashless oxidation inhibitors are phenolic ashless oxidation inhibitors used as oxidation inhibitors for a lubricating oil. Specific examples of the phenolic ashless oxidation inhibitors are 4,4'-methylenebis(2,6-di-tert-butylphenol), 4,4'-bis(2,6-di-tert-butylphenol), 4,4'-bis(2-methyl-6-tert-butylphenol), 2,2'-methylenebis(4-ethyl-6-tert-butylphenol), 2,2'-methylenebis(4-methyl-6-tert-butylphenol), 4,4'-butylidenebis(3-methyl-6-tert-butylphenol), 4,4'-isopropylidenebis(2,6-di-tert-butylphenol), 2,2'-methylenebis(4-methyl-6-nonylphenol), 2,2'-isobutylidenebis(4,6-dimethylphenol), 2,2'-methylenebis(4-methyl-6-cyclohexylphenol), 2,6-di-tert-butyl-4-methylphenol, 2,6-di-tert-butyl-4-ethylphenol, 2,4-dimethyl-6-tert-butylphenol, 2,6-di-tert-butyl-4(N,N'-dimethylamino-p-cresol), 2,6-di-tert-butyl-4(N,N'-dimethylaminomethylphenol), 4,4'-thiobis(2-methyl-6-tert-butylphenol), 4,4'-thiobis(3-methyl-6-tert-butylphenol), 2,2'-thiobis(4-methyl-6-tert-butylphenol), bis(3-methyl-4-hydroxy-5-tert-butylbenzyl)sulfide, bis(3,5-di-tert-butyl-4-hydroxybenzyl)sulfide, 2,2'-thio-diethylenebis[3-(3,5-di-tert-butyl-4-hydroxyphenyl)propionate], tridecyl-3-(3,5-di-tert-butyl-4-hydroxyphenyl)propionate, pentaerythrityl-tetraquis[3-(3,5-di-tert-butyl-4-hydroxyphenyl)propionate], octadecyl-3-(3,5-di-tert-butyl-4-hydroxyphenyl)propionate, and mixtures thereof.

An engine oil composition may be blended with one or more of the above-described ashless dispersants or with one or more amine-based ashless dispersants, such as phenyl-α-nephtylamine, alkylphenyl-α-nephtylamine, and dialkyldiphenylamine. Alternatively, the above-described phenolic ashless dispersants may be used in combination with the amine-based ashless dispersants.

The upper limit content of the above-described ashless oxidation inhibitors is 3.0 percent by mass, preferably 2.0 percent by mass. A content in excess of the upper limit would fail to achieve oxidation inhibition that balances the amount. No particular limitation is imposed on the lower limit content. However, a lower limit content of preferably 0.1 percent by mass, more preferably 0.3 percent by mass, contributes to reduction of the friction coefficient of an engine oil after being deteriorated.

An engine oil composition according to the present invention may be blended with friction modifiers other than the above-described molybdenumdithiocarbamates. Such friction modifiers may be molybdenumdithiophosphate, molybdenum disulfide, long-chain aliphatic amines, long-chain fatty acids, long-chain fatty acid esters, long-chain aliphatic alcohols.

Additives other than those described above which may be used in the present invention are corrosion inhibitors, such as petroleum sulfonates, alkylbenzene sulfonates, dinonylnaphthalene sulfonates, alkenylsuccinates, and polyalcohol esters; demulsifying agents, typical examples of which are polyalkylene glycol-based non-ionic surfactants, such as polyoxyethylenealkyl ether, polyoxyethylenealkylphneyl ether, and polyoxyethylenealkylnaphthyl ether; metal deactivators, such as imidazoline, pyrimidine derivatives, alkylthiadiazole, mercaptobenzothiazole, benzotriazole and derivatives thereof, 1,3,4-thiadiazolepolysulfide, 1,3,4-thiadizolyl-2,5-bisdialkyldithiocarbamte, 2-(alkyldithio) benzoimidazole, and β-(o-carboxybenzylthio) propionnitrile; and antifoamers, such as silicone, fluorosilicone, and fluoroalkyl ether.

When adding these additives to an engine oil composition according to the present invention, the corrosion inhibitors and demulsifying agents are each added in an amount of 0.1 to 15 percent by mass, the antifoamers are added in an amount of 0.0005 to 1 percent by mass, and the metal deactivators are added in an amount of 0.005 to 1 percent by mass, based on the total mass of the composition.

An engine oil composition according to the present invention may be used preferably in motorcycle engines, automobile engines, diesel engines for land use, and marine diesel engines.

The invention will be further described by way of the following examples which are provided for illustrative purposes only. The performances of engine oils used in the inventive examples and comparative examples were evaluated by the following performance evaluation tests.

(1) Engine motoring test: The friction torque of the whole of an engine was measured by driving at 1,500 rpm, at an oil temperature of 80° C., and at a water temperature of 80° C. In general, an engine oil has better fuel efficiency with a smaller value which indicates a smaller friction loss at each part of the engine.

(2) NOACK evaporation test (ASTM D 5800): The evaporation loss of each of the engine oils was measured after being heated at a temperature of 250° C. and under a constant pressure for one hour. An engine oil with a smaller value is less consumed during actual running.

(3) CCS viscosity (ASTM D 5293): This test evaluates the cranking performance of each of the engine oils. Engine oils with a smaller value have better low temperature viscosity characteristics.

INVENTIVE EXAMPLES 1–3

Table 1 shows the above performance evaluation test results of the engine oils of Inventive Examples 1–3. Each of the engine oils was formulated so as to have the same kinematic viscosity at 100° C. and high temperature high shear viscosity at 150° C. It is apparent from the results in Table 1 that the engine oils of Inventive Examples 1–3 had an excellent fuel efficiency, less evaporation loss, and an excellent low temperature viscosity. It is also apparent that these oils exhibited more excellent performance when being blended with a polymethacrylate-based viscosity index improver with a weight-average molecular weight of 250,000 than when being blended with one having a weight-average molecular weight of 150,000. Furthermore, it is apparent that the engine oils blend with molybdenumdithiocarbamate exhibited an excellent fuel efficiency.

COMPARATIVE EXAMPLES 1–3

Table 1 also shows the above performance evaluation test results of the engine oils of Comparative Examples 1–3. The engine oil of Comparative Example 1 with the base oil having a viscosity index of 100 was inferior in fuel efficiency, evaporation loss; and low temperature viscosity. The engine oil containing an olefin copolymer-based viscosity index improver (Comparative Examples 2) was inferior in fuel efficiency, evaporation loss, and low temperature viscosity. The engine oil of Comparative Example 3 with a kinematic viscosity of 9.3 or more was inferior in fuel efficiency even though being blended with molybdenumdithiocarbamate.

TABLE 1

| | Inventive Example 1 | Inventive Example 2 | Inventive Example 3 | Comparative Example 1 | Comparative Example 2 | Comparative Example 3 |
|---|---|---|---|---|---|---|
| Base oil I[1)] Mass % | 85.9 | 85.9 | 84.3 | | 79.7 | 82.3 |
| Base oil II[2)] mass % | | | | | 4.2 | |
| Base oil III[3)] mass % | | | | 85.9 | | |
| Viscosity index improver I[4)] mass % | 4.0 | | | | | |
| Viscosity index improver II[5)] mass % | | 4.0 | 4.0 | 4.0 | | 6.0 |
| Viscosity index improver III[6)] mass % | | | | | 6.0 | |
| MoDTC[7)] mass % | | | 1.6 | | | 1.6 |
| Additive Package[8)] mass % | 10.1 | 10.1 | 10.1 | 10.1 | 10.1 | 10.1 |

TABLE 1-continued

| | Inventive Example 1 | Inventive Example 2 | Inventive Example 3 | Comparative Example 1 | Comparative Example 2 | Comparative Example 3 |
|---|---|---|---|---|---|---|
| Kinematic viscosity (100° C.) $mm^2/s$ | 8.25 | 8.33 | 8.32 | 8.39 | 8.24 | 9.45 |
| High temperature high shear Viscosity (150° C.) mPa · s | 2.62 | 2.63 | 2.61 | 2.62 | 2.61 | 2.75 |
| Engine motoring friction torque Test N · m | (O) 19.6 | (O) 19.4 | (□) 18.1 | (X) 20.2 | (X) 20.2 | (X) 20.1 |
| NOACK Evaporation Mass % | (O) 14 | (O) 14 | (O) 14 | (X) 22 | (X) 17 | (O) 14 |
| CCS viscosity (−25° C.) mPa · s | (O) 3250 | (O) 3200 | (O) 3270 | (X) 4630 | (X) 4960 | (O) 3300 |

[1)]hydrocracking mineral oil: 4.2 $mm^2/s$ kinematic viscosity at 100° C., 3.1 mass % of total aromatic content, 125 viscosity index;
[2)]hydrocracking mineral oil: 2.6 $mm^2/s$ kinematic viscosity at 100° C., 2.1 mass % of total aromatic content, 104 viscosity index;
[3)]solvent-refined mineral oil: 4.5 $mm^2/s$ kinematic viscosity at 100° C., 25.3 mass % of total aromatic content, 100 viscosity index;
[4)]Polymethacrylate-based viscosity index improver: 150,000 weight-average molecular weight;
[5)]Polymethacrylate-based viscosity index improver: 250,000 weight-average molecular weight;
[6)]Olefin copolymer-based viscosity index improver: 250,000 weight-average molecular weight;
[7)]Molybdenumdithiocarbamate represented by the formula

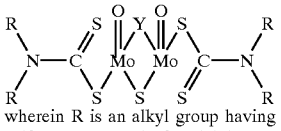

wherein R is an alkyl group having 8 or 13 carbon atoms, Y is oxygen or sulfur, 4.8 mass % of molybdenum concentration.
[8)]Additive mixtures containing calcium sulfonate, calcium salicylate, dialkyldithio zinc phosphate, succinimide-based ashless dispersant, phenol-based oxidation inhibitor, antifoamer, and corrosion inhibitor.

As described above, the present invention can provide an engine oil composition which excels in fuel efficiency and low temperature characteristics and encounters less evaporation loss.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. An engine oil composition consisting essentially of (A) a lubricating base oil having a kinematic viscosity at 100° C. of 3 to 6 $mm^2/s$, a viscosity index of 120 or more, and a total aromatic content of 5 percent by mass or less and (B) a polymethacrylate-based viscosity index improver having a weight-average molecular weight of 180,000 or more, (A) and (B) being blended in such amounts that the composition has a kinematic viscosity at 100° C. of 4.0 to 9.3 $mm^2/s$ and a high temperature, high shear viscosity at 150° C. of 2.4 to 2.7 mPa·s.

2. The engine oil composition according to claim 1 wherein, said polymethacrylate-based viscosity index improver is a polymer of a compound represented by the formula

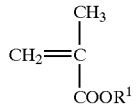

(1)

wherein $R^1$ is a straight chain or branched alkyl group having 1 to 18 carbon atoms.

3. The engine oil composition according to claim 1, wherein said polymethacrylate-based viscosity index improver is a copolymer obtained by copolymerizing one or more monomers selected form the group consisting of compounds represented by formula (1) with one or more nitrogen-containing monomers selected from the group consisting of compounds represented by the formulae

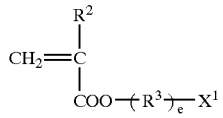

(2)

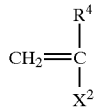

(3)

wherein $R^2$ and $R^4$ are each independently hydrogen or methyl, $R^3$ is a straight chain or branched alkylene group having 2 to 18 carbon atoms, e is an integer of 0 or 1, and $X^1$ and $X^2$ are each independently an amine residue or heterocyclic ring having 1 or 2 nitrogen atoms and 0 to 2 oxygen atoms.

4. The engine oil composition according to claim 1, further comprising at least one additive selected from the group consisting of alkaline earth metal detergents, ashless dispersants, wear inhibitors, ashless oxidation inhibitors, friction modifiers other than molybdenumdithiocarbamate, corrosion inhibitors, demulsifying agents, metal deactivators, and antifoamers.

5. The engine oil composition according to claim 1, wherein said lubricating base oil has a kinematic viscosity at 100° C. of 3 to 4.2 $mm^2/s$.

6. The engine oil composition according to claim 1, wherein said polymethacrylate-based viscosity index improver has a weight-average molecular weight of 180,000 to 500,000.

7. The engine oil composition according to claim 1, having a NOACK evaporation loss of 16 percent by mass or less.

8. The engine oil composition according to claim 1, having a CCS viscosity at −25° C. of 3500 mPa·s or less.

9. An engine oil composition consisting essentially of (A) a lubricating base oil having a kinematic viscosity at 100° C. of 3 to 6 $mm^2/s$, a viscosity index of 120 or more, and a total aromatic content of 5 percent by mass or less and (B) a polymethacrylate-based viscosity index improver having a weight-average molecular weight of 180,000 or more, (A) and (B) being blended in such amounts that the composition has a kinematic viscosity at 100° C. of 4.0 to 9.3 $mm^2/s$ and a high temperature high shear viscosity at 150° C. of 2.4 to 2.7 mPa·s, and (C) a molybdenumdithiocarbamate.

10. The engine oil composition according to claim 9 wherein, said polymethacrylate-based viscosity index improver is a polymer of a compound represented by the formula (1)

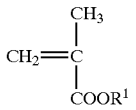

wherein $R^1$ is a straight chain or branched alkyl group having 1 to 18 carbon atoms.

11. The engine oil composition according to claim 9, wherein said polymethacrylate-based viscosity index improver is a copolymer obtained by copolymerizing one or more monomers selected form the group consisting of compounds represented by formula (1) with one or more nitrogen-containing monomers selected from the group consisting of compounds represented by the formulae (2)

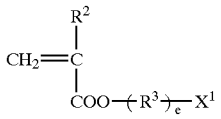

(3)

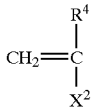

wherein $R^2$ and $R^4$ are each independently hydrogen or methyl, $R^3$ is a straight or branched alkylene group having 2 to 18 carbon atoms, e is an integer of 0 or 1, and $X^1$ and $X^2$ are each independently an amine residue or heterocyclic ring having 1 or 2 nitrogen atoms and 0 to 2 oxygen atoms.

12. The engine oil composition according to claim 9, wherein said molybdenumdithiocarbamate is present in an amount of 0.02 to 0.15 percent by mass in terms of molybdenum concentration, based on a total mass of the composition.

13. The engine oil composition according to claim 9, wherein said molybdenumdithiocarbamate is represented by the formula (4)

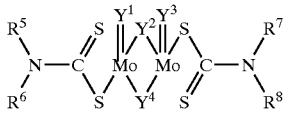

wherein $R^5$, $R^6$, $R^7$, and $R^8$ are the same or different and each is independently an alkyl or alkylaryl having 2 to 18 carbon atoms, and $Y^1$, $Y^2$, $Y^3$, and $Y^4$ are each independently selected from the group consisting of sulfur and oxygen.

14. The engine oil composition according to claim 9, further comprising at least one additive selected from the group consisting of alkaline earth metal detergents, ashless dispersants, wear inhibitors, ashless oxidation inhibitors, friction modifiers other than molybdenumdithiocarbamate, corrosion inhibitors, demulsifying agents, metal deactivators, and antifoamers.

15. The engine oil composition according to claim 9, wherein said lubricating base oil has a kinematic viscosity at 100° C. of 3 to 4.2 $mm^2/s$.

16. The engine oil composition according to claim 9, wherein said polymethacrylate-based viscosity index improver has a weight-average molecular weight of 180,000 to 500,000.

17. The engine oil composition according to claim 9, having a NOACK evaporation loss of 16 percent by mass or less.

18. The engine oil composition according to claim 9, having a CCS viscosity at −25° C. of 3500 m/Pa·s or less.

* * * * *